US006850463B2

(12) United States Patent
Winnacker

(10) Patent No.: US 6,850,463 B2
(45) Date of Patent: Feb. 1, 2005

(54) BOREHOLE LOGGING APPARATUS FOR DEEP WELL DRILLING

(75) Inventor: Helmut Winnacker, Burgdorf (DE)

(73) Assignee: Precision Drilling Technology Services GmbH, Edemissen (DE)

( * ) Notice: Subject to any disclaimer, the term of this patent is extended or adjusted under 35 U.S.C. 154(b) by 558 days.

(21) Appl. No.: 10/068,617

(22) Filed: Feb. 6, 2002

(65) Prior Publication Data

US 2002/0105858 A1 Aug. 8, 2002

(30) Foreign Application Priority Data

Feb. 8, 2001 (DE) ..... 101 06 080

(51) Int. Cl.[7] ..... H04H 9/00

(52) U.S. Cl. ..... 367/83; 340/854.3; 340/855.4; 367/84

(58) Field of Search ..... 367/82, 83, 84; 340/854.3, 854.4, 856.3

(56) References Cited

U.S. PATENT DOCUMENTS 4,235,021 A * 11/1980 Claycomb ..... 33/307
4,686,658 A * 8/1987 Davison ..... 367/85
4,689,775 A * 8/1987 Scherbatskoy ..... 367/83
4,771,408 A * 9/1988 Kotlyar ..... 367/83
5,073,877 A * 12/1991 Jeter ..... 367/84
5,473,579 A * 12/1995 Jeter ..... 367/85
2003/0016164 A1 * 1/2003 Finke et al. ..... 342/83

FOREIGN PATENT DOCUMENTS

DE 199 39 262 8/1999

* cited by examiner

*Primary Examiner*—Timothy Edwards, Jr.
(74) *Attorney, Agent, or Firm*—Collard & Roe, PC

(57) ABSTRACT

The invention is directed to a borehole logging apparatus for deep well drilling, with a signal transmitter for transmitting measured data obtained while drilling from a borehole through the drilling fluid to the earth's surface, and with an elongated housing which is adapted for insertion in the drilling fluid conduit of a drill string. Accommodated in the housing is a flow regulator with a control piston, which controls the cross-section of opening of a bypass opening in response to the pressure differential generated by a flow restrictor and in response to the force of a spring in such manner that the part of the drilling fluid current fed to the signal transmitter through the flow restrictor is maintained substantially constant, and the remaining excess drilling fluid current is routed to the drilling fluid conduit via the bypass opening.

7 Claims, 1 Drawing Sheet

BOREHOLE LOGGING APPARATUS FOR DEEP WELL DRILLING

BACKGROUND OF THE INVENTION

This invention relates to a borehole logging apparatus for deep well drilling, with a device for transmitting measured data obtained while drilling from a borehole through the drilling fluid to the earth's surface, with an elongated housing which is adapted for insertion in the drilling fluid conduit of a drill string, includes at its influx end an entrance opening leading into a central housing conduit and has, downstream from the entrance opening, a sealing ring effecting a seal against the drill string, which further includes a bypass opening arranged downstream from the sealing ring and leading from the central housing conduit into the drilling fluid conduit of the drill string, and, downstream from the bypass opening, has a passageway connecting the central housing conduit with the drilling fluid conduit of the drill string, said passageway being adapted to be throttled at least in part by a controllable closure element of a hydromechanical signal transmitter arranged in the housing, said closure element being repeatedly movable, at controlled intervals and in response to signals characteristic of measured data to be transmitted, from a passing position into a throttling position and back again into the passing position in order to generate in the drilling fluid a coded series of positive pressure pulses corresponding to the signals.

Apparatus of the type referred to are employed in particular in directional drilling in order to transmit measured data determined by measuring devices in the drill string while drilling to the earth's surface and, on the basis of such measured data, to permit the progress and direction of drilling to be influenced to the desired extent.

In a borehole logging apparatus of the type referred to which is known from DE 199 39 262 C1, fluid flow to the signal transmitter is through a central feed pipe arranged in the housing and surrounded by an exchangeable bypass ring, to which the entire drilling fluid current is fed through a filter pipe and through which part of the drilling fluid current is routed back to the drill string via bypass openings. By exchanging the bypass ring and, as the case may be, the feed pipe for parts having a different flow cross-section, this known apparatus is adaptable to different drill string diameters and flow velocities to be able to obtain in each case sufficiently significant pressure pulses for signal transmission. Each conversion necessitates however the removal of the borehole logging apparatus, which involves considerable expenditure of energy and time, with the attendant disadvantage of requiring a correspondingly long interruption of the drilling operation.

SUMMARY OF THE INVENTION

It is an object of the present invention to provide a borehole logging apparatus of the type initially referred to which enables the partial currents fed to the signal transmitter and the bypass opening to be adapted to different feed rates and drill string bores automatically. It is further desirable for the borehole logging apparatus to be insusceptible to failure and have a long service life.

This object is accomplished according to the present invention by arranging in the housing a flow regulator with a control piston, which controls the cross-section of opening of the bypass opening in response to the pressure differential generated by a flow restrictor and the force of a spring in such manner that the part of the drilling fluid current fed to the signal transmitter through the flow restrictor is maintained substantially constant, and the remaining excess drilling fluid current is routed to the drilling fluid conduit via the bypass opening.

The borehole logging apparatus of the present invention is independent of the delivery rate of the drill fluid pumps within a wide working range and therefore also suitable for different drill string bores. By suitably designing the flow regulator, the drilling fluid current fed to the signal transmitter can be set to a value optimal for the generation of significant pressure pulses, which value is then maintained at a substantially constant level during operation by means of a quantity-dependent regulation of the bypass cross-section. Depending on the amount of drilling fluid delivered, the bypass current can be between zero and a value equal to or even greater than the drilling fluid current fed to the signal transmitter. By virtue of the automatic, pressure-independent adaptation of the bypass current to fluctuating drill fluid delivery rates, interruptions of drilling operations, conversion work on the borehole logging apparatus and faults resulting from unfavorable bypass cross-sections are avoided.

According to the present invention, provision may furthermore be made for the control piston of the flow regulator to have a throttling section controlling the cross-section of passage of the bypass opening, and a measuring section serving as a pressure sensor, for the throttling section and the measuring section to be interconnected by a tappet, and for the throttling section disposed in the housing conduit disconnecting the bypass opening from the signal transmitter and being penetrated axially by a throttling conduit forming the flow restrictor. In this arrangement, the measuring section of the control piston may be arranged in a chamber disposed upstream from the entrance opening in the housing, which chamber is divided into two compartments by the measuring section, whereof the first compartment, which is located at the end of the measuring section remote from the tappet, is connected to the drilling fluid conduit of the drill string through a connecting bore, and whereof the second compartment, through which the tappet extends, is connected to the end of the housing conduit close to the signal transmitter through a longitudinal bore extending through the tappet and the throttling section and receives therein a compression spring bearing against the measuring section with a spring force. The configuration of the invention permits integrating the flow regulator into the slim cylindrical housing of a borehole logging apparatus using simple, low-cost components while maintaining a large cross-section of flow hardly impeding the drilling fluid current. As a result, the outside diameter of the borehole logging apparatus can be kept so small as to be suitable for use with deep drilling standard bores of coupling size 2⅞" and larger and to be withdrawable through the drill string from the derrick. The configuration of the invention furthermore ensures a minimum of abrasion because sharp turns in the drilling fluid current are avoided.

According to a further proposal of the invention, provision may be made for the control action of the control piston to be considerably dampened. This prevents the pressure pulses generated by means of the signal transmitter from setting the control piston in vibration, which would incur the risk of the control action and the service life of the flow regulator being impaired. Dampening is accomplishable simply by increasing the flow resistance needing to be overcome for filling and emptying the first and/or second compartment bounded by the measuring section.

The present invention will be explained in more detail in the following with reference to an embodiment illustrated in the accompanying drawings. In the drawings,

DESCRIPTION OF THE PREFERRED EMBODIMENT

Figure 1:
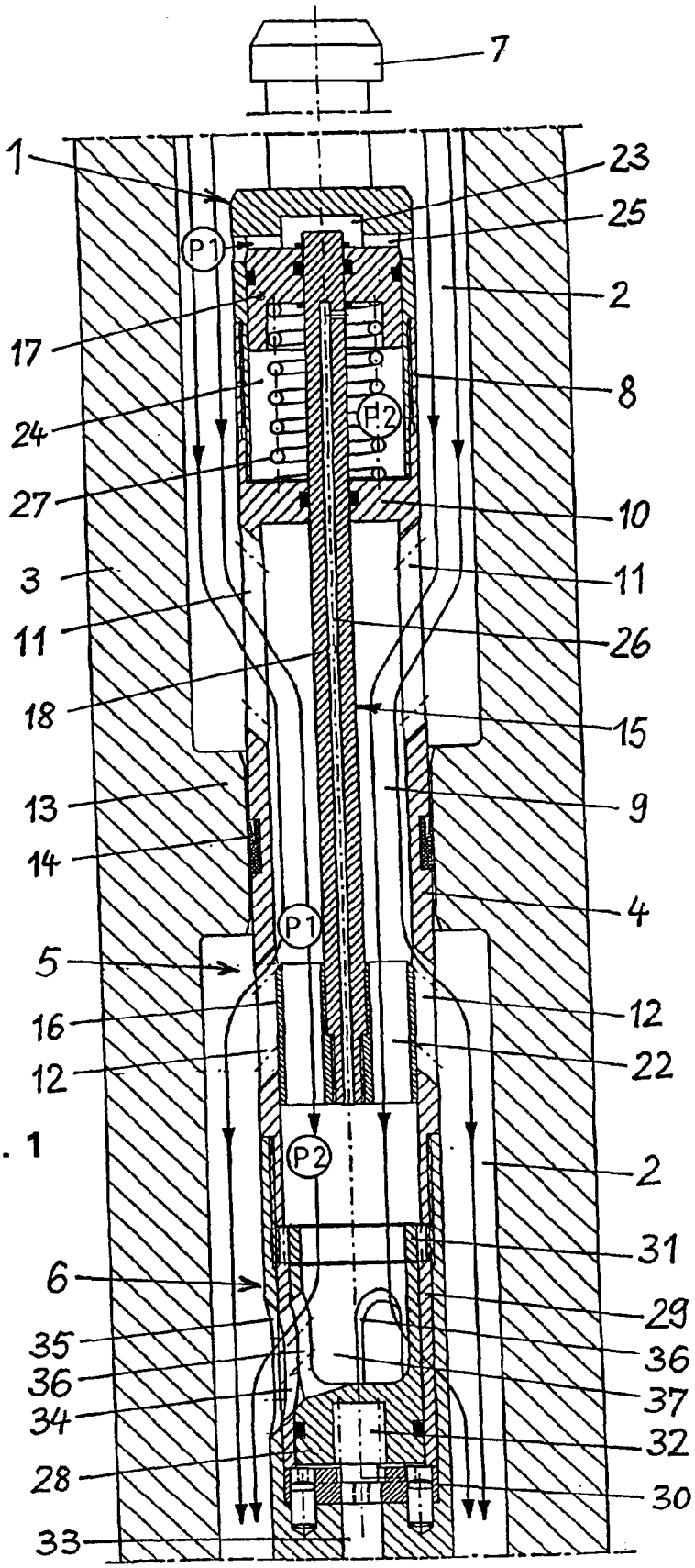
FIG. 1 is a longitudinal sectional view of a section of a drill string and a section of a borehole logging apparatus of the invention with flow regulator and hydromechanical signal transmitter.
Figure 2:
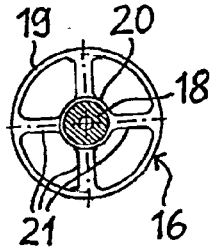
FIG. 2 is a cross-sectional view of the throttling section of the control piston of the borehole logging apparatus of FIG. 1.

FIG. 1 shows the upper section of a borehole logging apparatus 1 arranged in the drilling fluid conduit 2 of a drill collar 3 of a drill string for deep well drilling. The borehole logging apparatus 1 comprises a housing 4 composed of several housing parts bolted together and having the form of an elongated cylindrical rod. Arranged in the section of the housing 4 shown are a flow regulator 5 and a hydromechanical signal transmitter 6, while further units such as the drive of the signal transmitter 6, a measuring probe, a measuring transducer, a signal generator and an energy storage are arranged in the lower section of the housing 4, not shown. Provided at the upper end of the housing 4 is a catch hook 7 by which the borehole logging apparatus 1 is held by means of a gripper to enable it to be lowered into the drill string on a rope or pulled out again.

The illustrated section of the housing 4 has at its upper end a chamber 8 and a downwardly adjoining housing conduit 9 separated from the chamber 8 by a wall 10 and receiving the signal transmitter 6 at its lower end. Beneath the wall 10 the housing conduit 9 is in communication with the drilling fluid conduit 2 through entrance openings 11 and above the signal transmitter 6 through bypass openings 12. Between the entrance openings 11 and the bypass openings 12 the drilling fluid conduit 2 is interrupted by a constriction 13 formed by the drill collar 3, and the housing 4 is sealed against the constriction 13 by means of a seal 14. The drilling fluid current conveyed through the drilling fluid conduit 2 is therefore forced to enter the housing conduit 9 through the entrance openings 11, leaving the conduit beneath the constriction 13 through the bypass openings 12 and/or the signal transmitter 6.

The flow regulator 5 comprises a control piston 15 having a throttling section 16 and a measuring section 17 which are interconnected by a tappet 18. The throttling section 16 is arranged in the housing conduit 9 in the area of the bypass openings 12 in such manner as to be able to close the bypass openings 12 or open them wholly or in part. The throttling section 16 is comprised of two concentric sleeves 19, 20 interconnected by radial walls 21. The free annulus between the sleeves 19, 20 produces a throttling conduit through which fluid flow is directed to the signal transmitter 6 and whose throttling effect determines the control action of the control piston 15. The measuring section 17 is longitudinally displaceably mounted in the chamber 8 and sealed against the chamber wall. It divides the chamber 8 into two compartments 23, 24. Two bores 25 extending through the housing 4 provide for communication between the compartment 23 and the drilling fluid conduit 2. A longitudinal bore 26 within the tappet 18 provides for connection of the compartment 24 with the housing conduit 9 on the side of the throttling section 16 close to the signal transmitter 6. Furthermore, the compartment 24 houses a compression spring 27 acting upon the measuring section 17 with a spring force.

The signal transmitter 6 disposed at the lower end of the housing conduit 9 has a cylindrical, beaker-shaped rotor 28 and a stator sleeve 29 surrounding the rotor. The stator sleeve 29 is axially fixed in place in the housing 4 between an annular disk 30 non-rotatably arranged in the housing 4 and a threaded ring 31, and is maintained in a defined angular position in a manner preventing relative rotation by positive engagement of a claw within a recess in the annular disk 30. The rotor 28 is of an axial length less than the stator sleeve 29 and is equally mounted in the space between the annular disk 30 and the threaded ring 31. By means of a coupling 32 the rotor 28 is connected with a drive shaft 33 in a non-rotating relationship, taking support upon the drive shaft 33 in an axial direction so it is in a mid-position between the annular disk 30 and the threaded ring 31. As a result, the axial end surfaces of the rotor 28 are not in frictional contact with the opposite neighboring surfaces. The drive shaft 33 is mounted with zero play in the downwardly adjoining section, not shown, of the housing 4 by means of rolling thrust bearings. The rotary motion of the rotor 28 is limited to an angle of rotation of, for example, 45° by claw-type projections on its bottom, which engage within recesses in the annular disk 30.

In the wall of the stator sleeve 29 provision is made for a symmetrical arrangement of passageways 34, with openings 35 of matching size being provided in the opposite wall of the housing 4. The passageways 34 and the openings 35 are separated from one another in the circumferential direction by respective closed wall portions. The wall of the rotor 28 is likewise provided with passageways 34 which, in the illustrated position of the rotor 28, lie opposite the passageways 34, the passageways being likewise separated from each other by closed wall portion 36. The circumferential dimensions of the passageways 34 and wall portions 37 are coordinated so that on a rotation of the rotor 28 through the predetermined angle of rotation the wall portions 37 close the passageways 34.

Serving to drive the rotor 28 is a reversible direct-current motor linked to the drive shaft 33 by means of a reduction gear and a flexible coupling. To generate pressure pulse signals the direct-current motor is powered by current of changing direction so that it periodically reverses its direction of rotation, moving the rotor 28 alternately into the illustrated passing position and into the closing position offset by an angle of 45°, for example. The respective end position of the rotor 28 is sensed by an angle-of-rotation transducer for control of the direct-current motor.

In operation, drilling fluid is conveyed through the drilling fluid conduit 2 of the drill collar 3 and the housing 4 of the borehole logging apparatus 1 in the manner illustrated in the Figure by the arrowed lines, with the drilling fluid current being produced by drilling fluid pumps connected to the drill string on the earth's surface. The drilling fluid current entering the housing conduit 9 at a pressure P1 is throttled to a pressure P2<P1 as it passes the throttling conduit 22. The pressure differential P1−P2 becomes effective on the throttling section 16 and the measuring section 17 of the control piston 15 in the same direction and attempts to displace the control piston 15 in the direction of the signal transmitter 6 until the pressure forces and the force of the spring 27 counterbalance each other. The throttling effect of the throttling conduit 22 and the force of the compression spring 27 are designed in relation to the hydraulic effective areas of the control piston 15 so that the pressure differential P1−P2 produced by the drilling fluid current in the presence of a low delivery rate is not sufficient to overcome the spring force, hence causing the control piston 15 to be maintained in its upper stop position and close with its throttling section 16 the bypass openings 12 completely. The entire drilling fluid current is therefore routed through the signal transmitter 6 in order to enable it to produce sufficiently strong and significant pressure pulses. With the delivery rate of the drilling fluid current increasing, the pressure P1 increases too, while P2 is maintained substantially unchanged. By virtue of the higher pressure differential the control piston 15 is now moved downwardly against the force of the compression spring 27, and the bypass openings 12 are opened until the balance is established by the resulting dropping pressure P1. When the delivery rate of the drilling fluid current continues to increase, the control piston 15 opens the bypass openings 12 a wider amount, whereby the amount of bypass fluid increases, whilst the amount of drilling fluid routed to the signal transmitter 6 through the throttling conduit 22 remains essentially constant. Hence the flow regulator 5 is in a position to regulate the amount of bypass fluid between zero value and a value determined by the maximum opening cross-section of the bypass openings 12. In the entire range of control the amount of drilling fluid fed to the signal transmitter varies to the same degree as the pressure differential P1–P2, which increases to overcome the force of the compression spring 27, effects an increase in the amount of drilling fluid passing through the throttling conduit 22. The variation in the amount of drilling fluid fed to the signal transmitter 6 is low by comparison with the variation in the amount of bypass fluid. It can be influenced by the design of the spring characteristic of the compression spring 27.

The movements of the control piston 15 are considerably dampened by the throttling effect of the longitudinal bore 26, so that the control piston 15 cannot be set in vibration by the pressure pulses generated by the signal transmitter 6. During operation of the signal transmitter 6 the time average available for the discharge of the drilling fluid current diminishes due to the periodic opening and closing of the passageways 34. This results in a slight increase in P2 and a reduction in the bypass current with a corresponding increase in P1. This control action thus ensures that during operation of the signal transmitter 6 the amount of drilling fluid it has available at best increases slightly and is thus conducive to the generation of significant pressure pulses.

I claim:

1. A device for transmitting from a borehole through the drilling fluid signals characteristic of measured data obtained while drilling the borehole, comprising:

a hydromechanical signal transmitter responsive to signals characteristic to the measured data for generating in the drilling fluid a coded series of pressure pulses characteristic of the measured data; and a flow regulator for controlling the flow of drilling fluid through the signal transmitter in response to a pressure differential generated by a flow restrictor so that the flow of drilling fluid through the signal transmitter is maintained substantially constant.

2. A borehole logging apparatus for deep well drilling, comprising:

a device for transmitting from a borehole through the drilling fluid to the earth's surface signals characteristic of measured data obtained while drilling, an elongated housing which is adapted for insertion in the drilling fluid conduit of a drill string, includes at its influx end an entrance opening leading into a central housing conduit and has, downstream from the entrance opening, a sealing ring effecting a seal against the drill string, said elongated housing further includes a bypass opening arranged downstream from the sealing ring and leading from the central housing conduit into the drilling fluid conduit of the drill string, and, downstream from the bypass opening, a passageway connecting the central housing conduit with the drilling fluid conduit of the drill string, a hydromechanical signal transmitter arranged in the housing and controlling a closure element for throttling at least in part the flow of drilling fluid through said passage way, said closure element being repeatedly movable, at controlled intervals and in response to signals characteristic of measured data to be transmitted, from a passing position into a throttling position and back again into the passing position in order to generate in the drilling fluid a coded series of positive pressure pulses corresponding to said signals, wherein the housing accommodates in its interior a flow regulator having a control piston, which controls the flow of drilling fluid through the bypass opening in response to the pressure differential generated by a flow restrictor and in response to the force of a spring in such manner that the part of the flow of the drilling fluid fed to the signal transmitter through the flow restrictor is maintained substantially constant, and the remaining excess of the flow of the drilling fluid is routed to the drilling fluid conduit via the bypass opening.

3. The borehole logging apparatus as claimed in claim 2, wherein the movement of the control piston is dampened hydraulically.

4. The borehole logging apparatus as claimed in claim 2, wherein the control piston has a throttling section disposed in the central housing conduit and controlling the cross-section of passage of the bypass opening, and a measuring section serving as a pressure sensor, the throttling section and the measuring section are interconnected by a tappet.

5. The borehole logging apparatus as claimed in claim 4, wherein the throttling section separates the bypass opening from the signal transmitter and is penetrated axially by a throttling conduit forming the flow restrictor.

6. The borehole logging apparatus as claimed in claim 4, wherein the measuring section is arranged in a chamber disposed upstream from the entrance opening in the housing, which chamber is divided into two compartments by the measuring section, whereof the first compartment, which is located at the end of the measuring section remote from the tappet, is connected to the drilling fluid conduit of the drill string through a connecting bore, and whereof the second compartment, through which the tappet extends receives therein a compression spring bearing against the measuring section with a spring force, and is connected to the end of the housing conduit downstream the throttling section through a longitudinal bore extending through the tappet and the throttling section.

7. The borehole logging apparatus as claimed in claim 6, wherein the flow through the connecting bore and/or the longitudinal bore is restricted in order to dampen hydraulically the movement of the control piston.

* * * * *